US006573805B2

(12) United States Patent
Hidaka et al.

(10) Patent No.: US 6,573,805 B2
(45) Date of Patent: Jun. 3, 2003

(54) RESONATOR, FILTER, DUPLEXER, AND COMMUNICATION DEVICE

(75) Inventors: Seiji Hidaka, Nagaokakyo (JP); Michiaki Ota, Nagaokakyo (JP); Yasuo Fujii, Nagaokakyo (JP); Shin Abe, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/891,680

(22) Filed: Jun. 26, 2001

(65) Prior Publication Data

US 2002/0000893 A1 Jan. 3, 2002

(30) Foreign Application Priority Data

Jun. 26, 2000 (JP) ..... 2000-191641

(51) Int. Cl.[7] ..... H01P 1/20; H01B 12/02

(52) U.S. Cl. ..... 333/99 S; 505/210; 333/202; 333/219; 333/134

(58) Field of Search ..... 333/99 S, 134, 333/202, 204, 219

(56) References Cited

U.S. PATENT DOCUMENTS 3,629,738 A * 12/1971 Senf ..... 333/84 M
4,981,838 A * 1/1991 Whitehead ..... 505/1
5,974,335 A * 10/1999 Talisa et al. ..... 505/210
6,075,427 A * 6/2000 Tai et al. ..... 333/219
6,144,268 A * 11/2000 Matsui et al. ..... 333/134

FOREIGN PATENT DOCUMENTS

JP 2096402 * 4/1990

* cited by examiner

*Primary Examiner*—Michael Tokar
*Assistant Examiner*—Vibol Tan
(74) *Attorney, Agent, or Firm*—Dickstein, Shapiro, Morin & Oshinsky, LLP.

(57) ABSTRACT

A resonator, a filter, and a duplexer are provided which are capable of very effectively suppressing the power loss caused by the edge effect, and which allow a great reduction in the overall size to be achieved. Also, a communication device including the above-mentioned filter or duplexer is provided. A ground electrode is formed over the bottom surface of a dielectric substrate, and a multiple spiral line pattern is formed on the top surface thereof. A radial line pattern is further formed on this surface with an insulation layer interposed therebetween. By thus disposing the radial pattern adjacently to the multiple spiral resonator constituted of the above-mentioned multiple spiral line, an electrostatic capacitance is added to the multiple spiral resonator. This reduces the occupation area of the resonator on the substrate, and improves the loss reduction effect.

14 Claims, 16 Drawing Sheets

RESONATOR, FILTER, DUPLEXER, AND COMMUNICATION DEVICE

BACKGROUND OF THE INVENTION

1. Field of the Invention

The present invention relates to a filter, a duplexer, and a communication device for use in radio communication or the transmission/reception of electromagnetic waves, in e.g. a microwave band or a millimeter wave band.

2. Description of the Related Art

An example of a miniaturizable resonator for use in a microwave band or millimeter wave band is a spiral resonator, disclosed in Japanese Unexamined Patent Application Publication No. 2-96402. This spiral resonator is able to fit a longer resonance line in a given occupation area by forming the resonance line into a spiral shape, thereby achieving its overall size-reduction.

In such a conventional resonator, one half-wavelength line constitutes one resonator. Therefore, in a conventional resonator, the region where electrical energy is concentrated and stored, and the region where magnetic energy is concentrated and stored are separated from each other, and they are unevenly distributed at specified areas of a dielectric substrate. More specifically, the electrical energy is stored in the vicinity of an open end of the half wavelength line, while the magnetic energy is stored in the vicinity of the center portion of the half wavelength line.

Such a resonator constituted of one microstrip line has a drawback, in that characteristics thereof are inevitably subjected to deterioration caused by the edge effect which the microstrip line intrinsically possesses. Specifically, considering the line in cross-section, current is concentrated in the edge portions of the line (both ends in the width direction, and the upper and lower faces in the thickness direction of the line). Even if the film-thickness of the line is increased, the problem of power loss due to the edge effect inescapably occurs, since the edge portions at which the current is concentrated, can not be widened even if the film thickness of the line is increased.

SUMMARY OF THE INVENTION

In view of these problems, the present invention provides a resonator, a filter, and a duplexer which are capable of very effectively suppressing power loss caused by the edge effect, and which allow a greater reduction in overall size to be achieved. The invention also provides a communication device including the above-mentioned filter or duplexer.

In response to the above-described problems, the present invention, in a first aspect, provides a resonator comprising a plurality of line patterns, each of which is an aggregate of a plurality of lines, in each of which first and second ends of at least a portion of the plurality of lines are each disposed substantially at inner and outer periphery portions of the aggregate, around a predetermined point of a substrate, preferably symmetrically, and are disposed on the substrate so as not to intersect each other, in a mutually isolated state. In this resonator, each line of at least one of the plurality of line patterns has a spiral shape, and each line of at least one of the other line patterns has a pattern different from the line having a spiral shape.

In accordance with a second aspect, the present invention provides a resonator which resonates in a resonant mode of an integral multiple of a half-wave length. This resonator comprises a line pattern, which is an aggregate of a plurality of lines each having a spiral shape, in which first and second ends of at least a portion of the plurality of lines are each disposed substantially at inner and outer periphery portions of the aggregate, around a predetermined point of a substrate, preferably symmetrically, in which each of the inner and outer periphery portions of the line patterns is usable as a voltage opening end, and which are disposed on the substrate so as not to intersect each other. This resonator further comprises another line pattern which adds an electrostatic capacitance, utilizing the potential difference or a portion of the potential difference between the voltage node and the voltage antinode in the resonant mode. This other line pattern is disposed on a substrate in a state of being isolated from the above-described line pattern.

In the above-described plurality of spiral conductor patterns, spiral lines having substantially the same shapes are adjacent to each other. When microscopically seeing these spiral lines, physical edges exist in reality and weak edge effects occur at the edges of each of the lines. However, when macroscopically seeing the aggregate of these plural lines as one line, so to speak, the left edge of one line for example, is adjacent to the right neighborhood of another line which is congruent with the first line. That is, there are effectively no edges in the width direction of the lines. In other words, the existence of edges becomes insignificant. Utilizing this effect, the current concentration at edges of lines is very efficiently relieved and thereby the overall power loss is suppressed.

Furthermore, by disposing another line pattern adjacently to the line pattern in which each of the lines has a spiral shape, an electrostatic capacitance is equivalently added to the above-described line pattern constituted of spiral lines, whereby the resonant frequency is reduced, and by previously setting the line length of each of the spiral lines to be short, an overall size-reduction is achieved. Also, when forming line patterns having a given diameter, the loss reduction effect can be more enhanced by increasing the number of lines.

Preferably, at least one of the above-described plurality of line patterns is arranged, for example, radially.

It is preferable that each of at least two of the above-described plurality of line patterns be an aggregate of a plurality of spiral lines, and that the spiral directions thereof be opposite to each other. This allows the resonator to efficiently retain the magnetic-field energy by resonance and increases the Q value of the resonator.

In at least one of the above-described plurality of line patterns, preferably, portions which have substantially the same electrical potential in a resonant state are conductively connected. This effectively suppresses a spurious resonant mode.

It is preferable that at least one of the above-described plurality of line patterns is formed of a superconducting line. This increases the Q value of the resonator, allows sufficient low loss characteristics to be obtained, and enables the resonator to operate at a high Q value at a level not more than the critical current density.

Preferably, each of the line widths of the above-described plurality of line patterns is set to be substantially equal to the skin depth of the line conductor or narrower than the skin depth thereof, at an operating frequency. Thereby, the distance between the left and right inter-line gaps of a line becomes a distance such that the currents which flow in order to retain the magnetic flux passing through the gaps cause interference between left-side current and right-side one, and thereby reactive current having a phase deviated from the resonant phase is suppressed. This leads to a remarkable reduction in power loss.

In accordance with a third aspect, the present invention provides a filter which is formed by providing signal input/output portions to be connected to a resonator having any one of the above-described structures.

In accordance with a fourth aspect, the present invention provides a duplexer which is formed by providing one of the above-described filters as a transmitting filter or a receiving filter, or by providing one of the above-described filters as both a transmitting and a receiving filter.

The above-described filter or duplexer, allows a reduction in the insertion loss and an overall size-reduction to be achieved.

In accordance with a fifth aspect of the present invention, there is provided a communication device which is formed using the above-described filter or duplexer. This makes it possible to reduce the insertion loss at high-frequency transmission/reception portions, to improve communication qualities such as the noise characteristics and the transmission speed, and to reduce the overall size of this communication device.

The above and other features and advantages of the present invention will be clear from the following detailed description of the embodiments of the invention in conjunction with the accompanying drawings.

DETAILED DESCRIPTION OF EMBODIMENTS OF THE INVENTION

First, the principle of the resonator in accordance with the present invention will be described with reference to FIGS. 1A–4B.

Figure 1A:
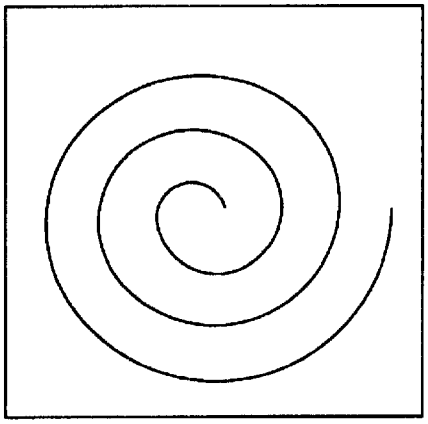
FIGS. 1A to 1D are views showing the configuration of a resonator constituted of a multiple spiral line.
Figure 1B:
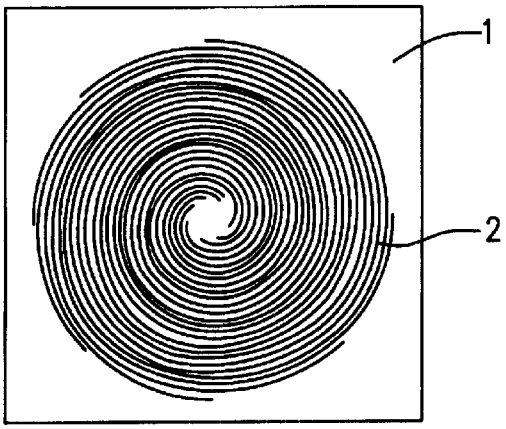
Figure 1C:
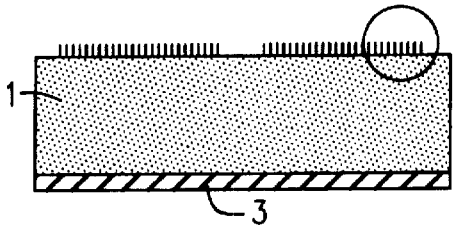
Figure 1D:
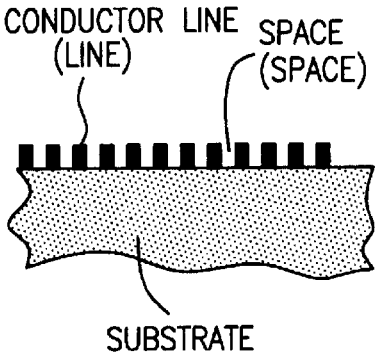

FIG. 1B is a top view showing the configuration of the resonator, FIG. 1C is a sectional view, and FIG. 1D is a partial enlarged view. A ground electrode 3 is formed over the entire bottom surface of a dielectric substrate 1. Eight mutually congruent spiral lines 2 each of which has open ends at both ends, are arranged on the top surface of the dielectric substrate so as not to intersect one another in a manner such that both ends of each of the lines are positioned, preferably symmetrically, around a predetermined point (the center point) on the substrate. FIG. 1A representatively shows one line among the eight lines. The width of each of these lines is set to be substantially equal to the skin depth thereof at a frequency of intended use. Hereinafter, an aggregate of such spiral lines is referred to as a "multiple spiral line".

Figure 2:
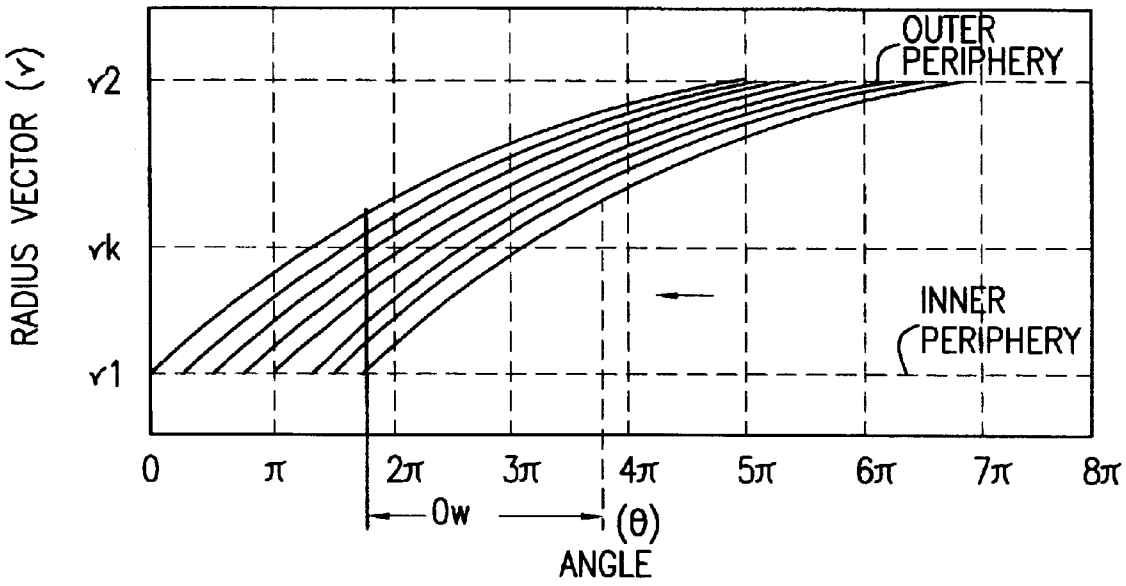
FIGS. 2 and 2A are diagrams showing the pattern of the multiple spiral line shown in FIGS. 1A to 1D, the pattern being expressed in Cartesian coordinates converted from polar coordinates.
Figure 2A:
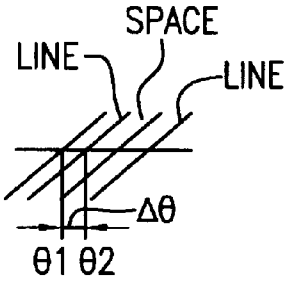

FIG. 2 shows the shape of the eight lines shown in FIG. 1B, using parameters of the polar coordinates. In this example, the radius vector r1 of the inner peripheral edge and the radius vector r2 of the outer peripheral edge of each of the eight lines are constant, and the positions in the angular direction of each of the edges are uniformly spaced. Referring to FIG. 2A, when the angle at the left end at an arbitrary radius vector is $\theta 1$, and the angle at the right end is $\theta 2$, the angle width $\Delta\theta$ of a line is expressed by $\Delta\theta=\theta 2-\theta 1$. Here, since the number of lines n=8, the angle width $\Delta\theta$ of one line is set to satisfy the relationship $\Delta\theta \leqq 2\pi/8(=\pi/4)$ radians. Also, the overall angle width $\theta w$ of the aggregate of the lines at an arbitrary radius vector rk is set to be within $2\pi$ radians.

These lines are coupled by mutual inductance and electrostatic capacitance. The combination of this multiple spiral line and the ground electrode 3 which are opposed to each other with the dielectric substrate 1 therebetween, works as a resonator. Hereinafter, this resonator is referred to as a "multiple spiral resonator". Here, the radius vectors r1 and r2 are neither necessarily required to be constant, nor arranged at equal angles. Furthermore, these lines are not necessarily required to be congruent. However, from the viewpoint of characteristics of the resonator and the ease of manufacturing thereof, it is desirable that r1 and r2 be constant, and that congruent lines be arranged at equal angles.

Figure 3:
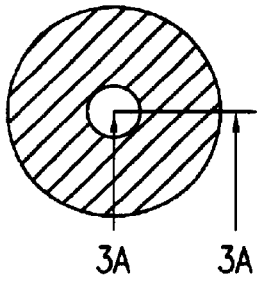
FIGS. 3, 3A and 3B are views showing an example of the distribution of an electromagnetic field in the resonator shown in FIGS. 1A to 1D.
Figure 3A:
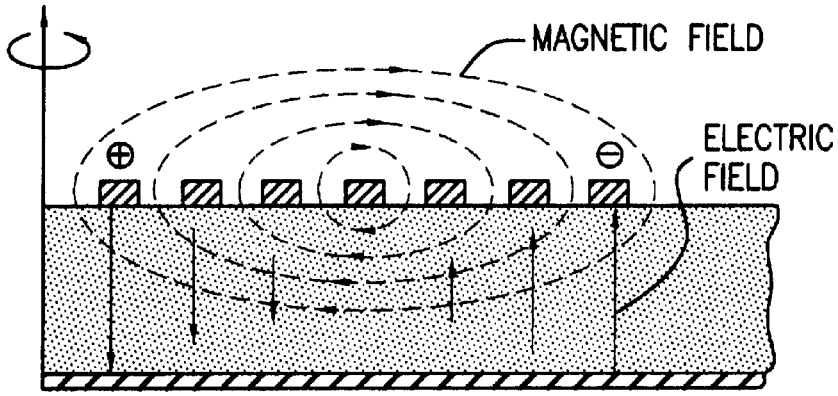
Figure 3B:
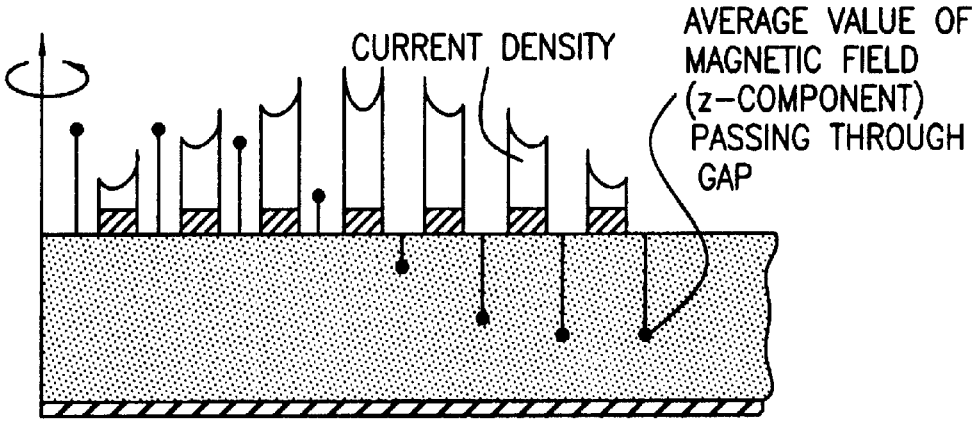

FIGS. 3–3B show an example of the distributions of an electromagnetic field and current in the multiple spiral line. FIG. 3 is a plan view showing a multiple spiral line, but the multiple spiral line is expressed by entirely shading the resonator without separating discrete lines. FIG. 3A shows the distributions of an electric field and a magnetic field along the cross-section 3A—3A of the multiple spiral line at the moment in which the charge at the inner peripheral edge and the outer peripheral edge of the lines is the largest. The lowermost view shows the current density of each of the lines at the above-mentioned cross-section and the average value of the z-component (in the direction perpendicular to the plan of the figure) of a magnetic field passing through each of the gaps between lines, at the above-mentioned moment.

When microscopically viewing each of the lines, the current density increases at the edges of each of the lines, as shown in the figure. However, when macroscopically viewing a cross section in the radius vector direction, since currents having substantially equal amplitude and phase flow through adjacent conductor lines, with a specified spacing therebetween, the edge effect is lessened. That is, when viewing the multiple spiral line as effectively one line, the current density is distributed substantially sinusoidally in such a manner that the inner peripheral edge and the outer peripheral edge become nodes of current distribution, and the center portion becomes the antinode thereof, thereby macroscopically causing no edge effect.

Figure 4:
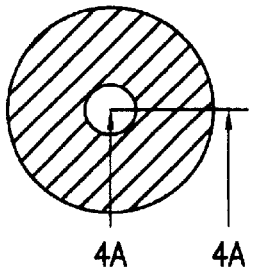
FIGS. 4, 4A and 4B are views showing an example of the distribution of an electromagnetic field of another resonator.
Figure 4A:
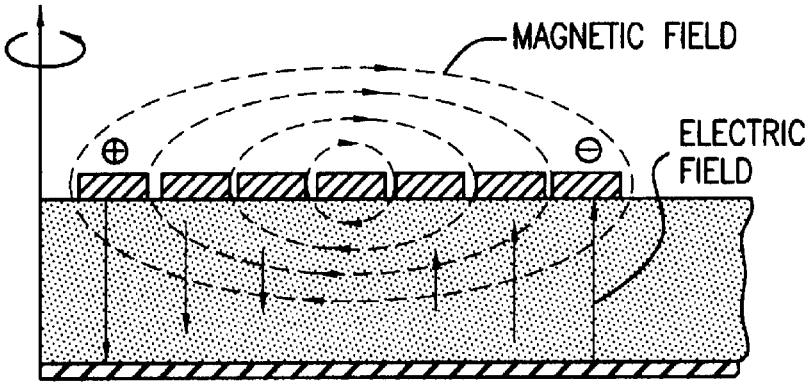
Figure 4B:
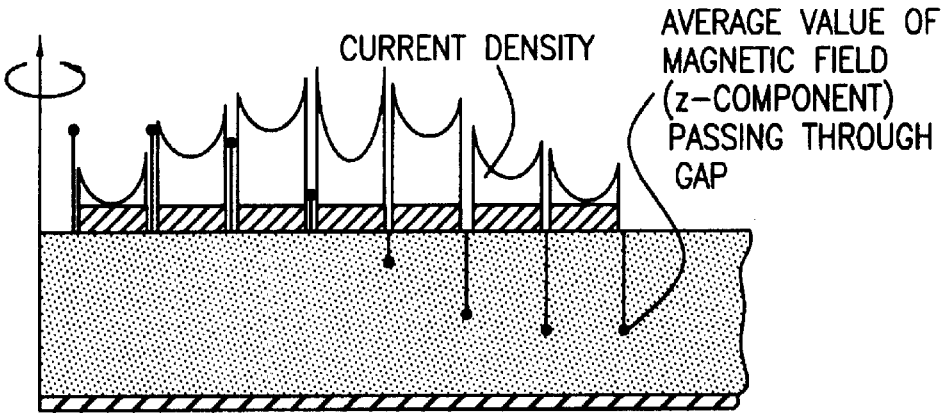

FIGS. 4–4B show a comparative example wherein the line width shown in FIGS. 3–3B has been widened up to several times the skin depth. When the line width is thus widened, current concentrations due to the edge effect in the conductor lines manifest themselves, as shown in the figure, thereby reducing the loss reduction effect.

Next, the configuration of the resonator in accordance with a first embodiment of the present invention will be described with reference to FIGS. 5A–6A.

Figure 5A:
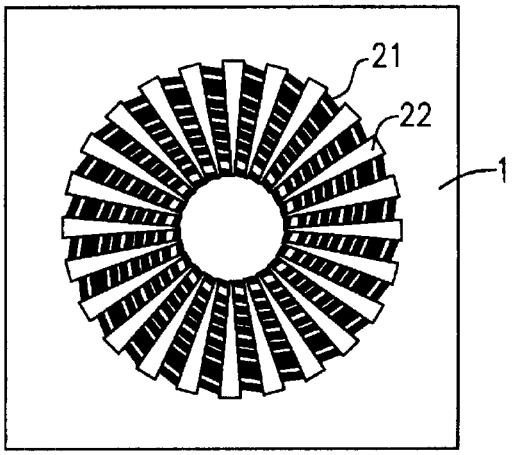
FIGS. 5A to 5D are views showing the configuration of a resonator in accordance with a first embodiment of the present invention.
Figure 5B:
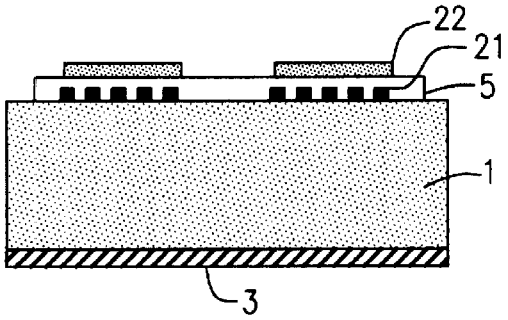
Figure 5C:
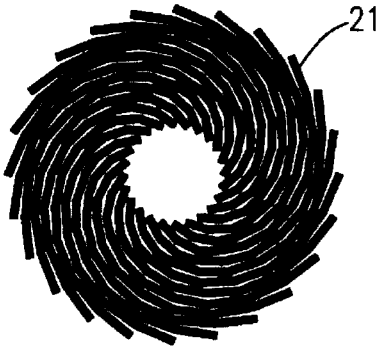
Figure 5D:
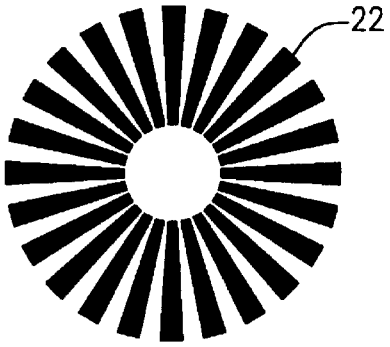

FIG. 5A is a top view of the resonator, FIG. 5B is a central vertical section, and FIGS. 5C and 5D are plan views of two line patterns. A ground electrode 3 is formed over the entire bottom surface of a dielectric substrate 1, and a plurality of spiral line patterns 21 are formed on the top surface. FIG. 5C is an example of the spiral line patterns, and a plurality of mutually congruent spiral lines 21 each of which has open ends at both ends, are arranged on the top surface of the dielectric substrate so as not to intersect one another in a manner such that first and second ends of each of the lines are rotation-symmetrically positioned around a predetermined point (the center point) on the substrate.

In FIG. 5B, reference numeral 5 denotes an insulating layer, and on the top surface thereof, a line pattern 22 different from the above-described line pattern 21 is formed. FIG. 5D is an example of the line pattern 22.

A plurality of mutually congruent spiral lines 21 each of which has open ends at both ends, are arranged on the top surface of the dielectric substrate so as not to intersect one another in a manner such that the first ends and the second ends of each of the lines are positioned around the above-described predetermined point. Each of the line widths of the line patterns 21 and 22 is set to be substantially equal to the skin depth of the line conductor, in an operating frequency band.

For the conductors for above-described line patterns 21 and 22, and ground electrode 3, metallic materials such as Al, Cu, Ni, Ag, Au, etc. are used. For the insulating layer 5, an insulating material such as $SiO_2$, $Al_2O_3$, or BCB (benzocyclobutene) is employed.

Specifically, an $Al_2O_3$ film is formed over the surface of the dielectric substrate 1, as a protective film, and a Ti thin film is formed as an adhesion film. Cu is deposited or sputtered over this surface, as a seed for growing the plating film, and the Cu conductors are then grown by plating. Moreover, over this surface, a Ni film is plated as a diffusion protective layer. An Au plating film is formed over the uppermost surface in order to bond wires for signal input/output. In the state wherein metallic thin films are thus formed over the $Al_2O_3$ film, a line pattern shown in FIG. 5C is formed, by means of the photolithography. That is, patterning is performed by the following procedures: photoresist film application→drying and curing→mask→exposure→development→baking→etching.

The insulating layer 5 is then formed by depositing or sputtering the above-described insulating material, and then the line pattern 22 is formed on the surface of the deposited or sputtered surface, as in the case of the above-described line pattern 21.

The line patterns 21 and 22, and the ground electrode 3 may be constituted of a high-temperature superconductor material. Thereby, the Q value of the resonator can be increased. The current concentration in this case is low, and hence, even if power density per unit area or unit volume is increased, it is possible to make good use of the low loss characteristics of the superconductor at a level not more than the critical current density, and to make the resonator operate at a high Q value.

The resonator shown in FIGS. 5A to 5D works as a multiple spiral resonator as shown in FIGS. 1A to 4B, by combining the multiple spiral line 21 and the ground electrode 3 which are disposed so as to be opposed to each other with the dielectric substrate 1 therebetween.

Figure 6A:
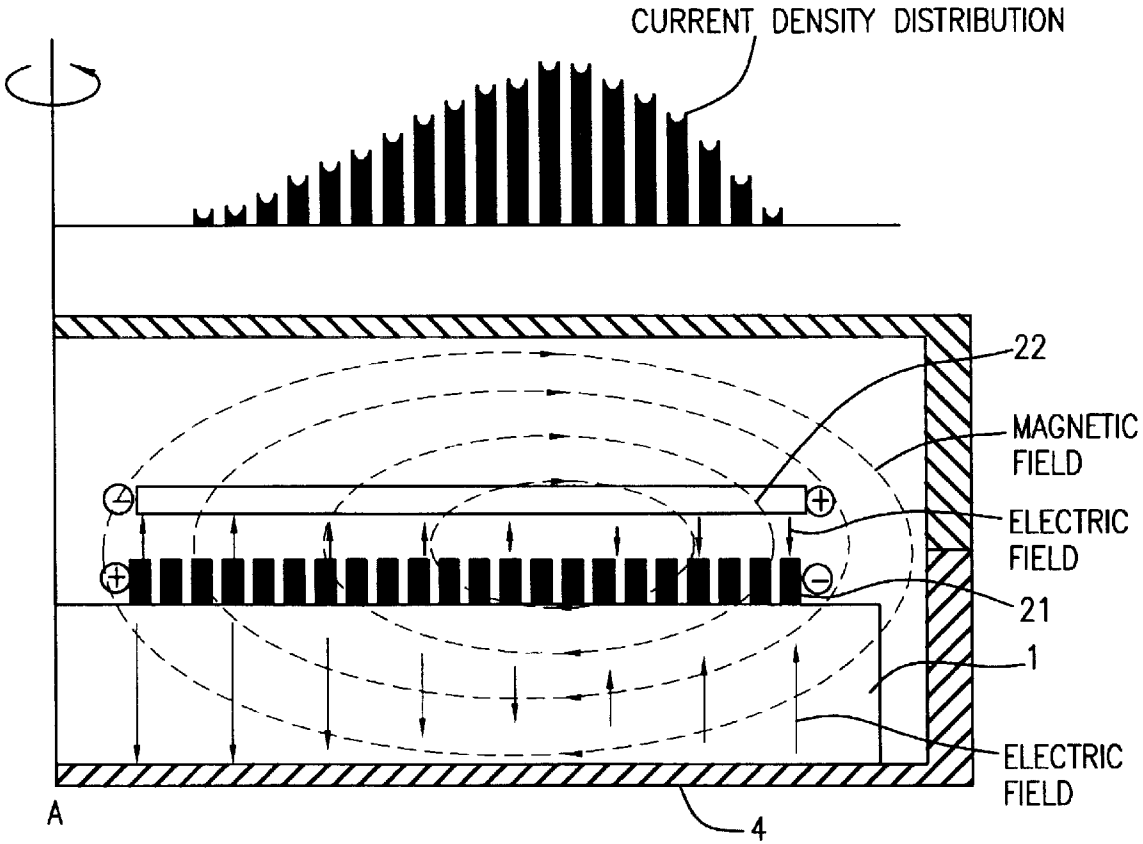
FIGS. 6 and 6A are views showing an example of the distributions of an electromagnetic field and a current density in the resonator shown in FIGS. 5A to 5D.
Figure 6:
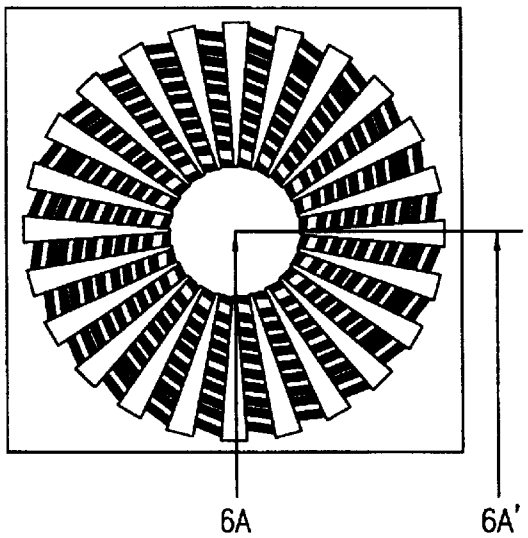

FIG. 6A shows an example of the distribution of an electromagnetic field and a current density in the above-described resonator. The lower portion of the distribution view shows the distribution of the electromagnetic field and that of the current density at the cross-section 6A–6A' of this resonator shown in FIG. 6. The upper portion of the distribution view shows the distribution of the current density in each of the lines at this cross-section, at the same moment in time.

In this multiple spiral resonator, when the inner periphery portion exhibits the maximum potential, the outer periphery portion exhibits the minimum potential. At the time when a half of the resonant period has elapsed, this potential relation between the inner and outer periphery portions is reversed. Therefore, when the radial line pattern 22 which runs from the inner periphery portion and the outer periphery portion of the multiple spiral line, is disposed adjacent to the multiple spiral line, an electrostatic capacitance is added, due to the potential difference between the inner periphery portion and the outer periphery portion of the multiple spiral line. More specifically, an electrostatic capacitance is distributed between the multiple spiral line 21 and the radial spiral line 22 from the inner periphery portion to the outer periphery portion of the multiple spiral line, via the insulating layer 5. Thus, the potential difference generated between the multiple spiral pattern and the radial line pattern becomes opposite in sign, between the inner periphery portion and the outer periphery portion, as shown in FIG. 6A.

In other words, the line pattern 22 adds an electrostatic capacitance utilizing the potential difference or a portion of the potential difference between the voltage node and the voltage antinode of in the resonant mode, of the line pattern 21.

The reason why the peak of the current density distribution is situated toward the outer periphery, as seen in FIG. 6A, is because the middle point (the 50% position) along the line length corresponds to the 70% position along the radius.

Since the resonant frequency is reduced by this added capacitance, the multiple spiral line's diameter for obtaining a predetermined resonant frequency can be reduced, by setting the length of each line of the multiple spiral line to be reduced in response to the amount of above-mentioned reduction in the resonant frequency. Also, when forming a multiple spiral line having a given diameter, the number of lines can be increased, and a correspondingly higher loss-reduction effect can be achieved.

Figure 7A:
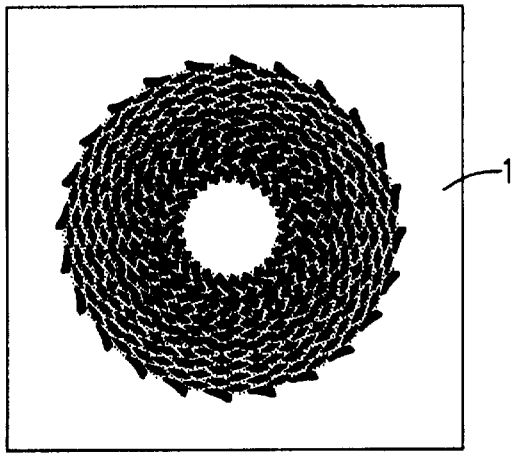
FIGS. 7A to 7D are views showing the configuration of a resonator in accordance with a second embodiment of the present invention.
Figure 7B:
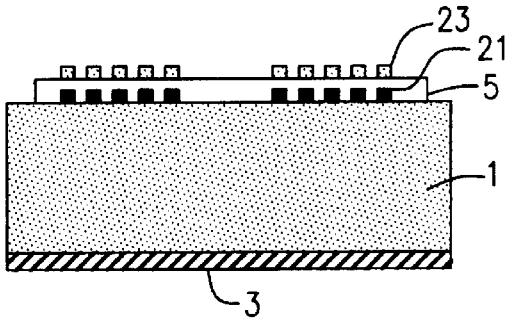
Figure 7C:
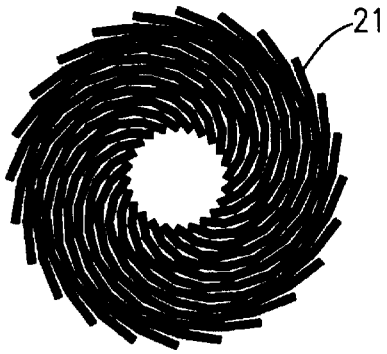
Figure 7D:
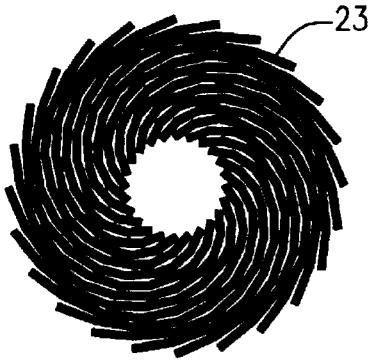

Next, the configuration of the resonator in accordance with a second embodiment of the present invention will be described with reference to FIGS. 7A to 7D. FIG. 7A is a top view of the resonator, FIG. 7B is a central vertical section, and FIGS. 7C and 7D are plan views of two line patterns. A ground electrode 3 is formed over the entire bottom surface of a dielectric substrate 1, and on the top surface thereof, a multiple spiral line is formed of a line pattern 21 constituted of a plurality of spiral lines, as shown in FIG. 7C. This line pattern 21 is similar to the one shown in FIGS. 5A to 5D. In FIG. 7B, reference numeral 5 denotes an insulating layer, and a line pattern 23 is formed on the top surface of this insulating layer. FIG. 7D shows an example of this line pattern 23. Herein, first ends and second ends of a plurality of lines are each arranged substantially at inner and outer periphery portions around the same center point as the multiple spiral line formed of line pattern 21, and each of the spiral lines is disposed so that the plurality of lines do not intersect each other. The spiral direction of these lines is, however, opposite to that of the lines of the line pattern 21.

The width of each of these line patterns 21 and 23 is set to be substantially equal to the skin depth of the line conductor, at an operating frequency.

With this structure, in a resonant mode at a desired resonant frequency, when the inner periphery portion of the line pattern 21 exhibits the maximum potential, the outer periphery portion exhibits the minimum potential. On the other hand, at this time, the inner periphery portion of the other line pattern 23 exhibits the minimum potential, and the outer periphery portion exhibits the maximum potential. That is, the first multiple spiral resonator which is formed of the line pattern 21 and the ground 3 with the dielectric substrate 1 therebetween, and the second multiple spiral resonator which is formed of the line pattern 23 and the ground 3 with the dielectric substrate 1 therebetween, exhibit opposite phases to each other. This is because, since an electrostatic capacitance is distributed between the line pattern 21 and the line pattern 23 from the inner periphery portion to the outer periphery portion of the line pattern 21, via the insulating layer 5, the potential difference generated between the line pattern 21 and the line pattern 23 becomes opposite in sign, between the inner periphery portion and the outer periphery portion. This is equivalent to the addition of an electrostatic capacitance to the multiple spiral resonator. As in the case of the first embodiment, this allows the diameter of the multiple spiral resonator to be reduced, and hence, when forming line patterns having a given diameter, the loss reduction effect can be enhanced by increasing the number of lines.

The current flowing through each of lines of the multiple spiral line 21 flows leftward from the inner periphery portion to the outer periphery portion when the inner periphery portion exhibits the maximum potential and the outer periphery portion exhibits the minimum potential. On the other hand, the current flowing through each of lines of the other multiple spiral line 23 flows leftward from the outer periphery portion to the inner periphery portion, since the outer periphery portion exhibits the maximum potential and the inner periphery portion exhibits the minimum potential. Therefore, since both currents flowing in the multiple spiral lines 21 and 23 flow in the same spiral direction, magnetic field energy can be efficiently retained. This results in an increased Q value of the resonator.

Figure 8A:
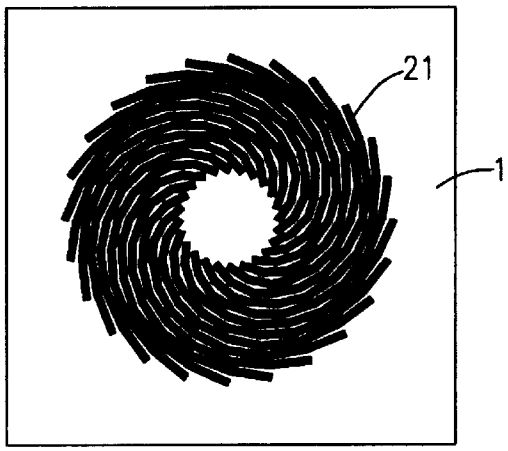
FIGS. 8A to 8D are views showing the configuration of a resonator in accordance with a third embodiment of the present invention.
Figure 8B:
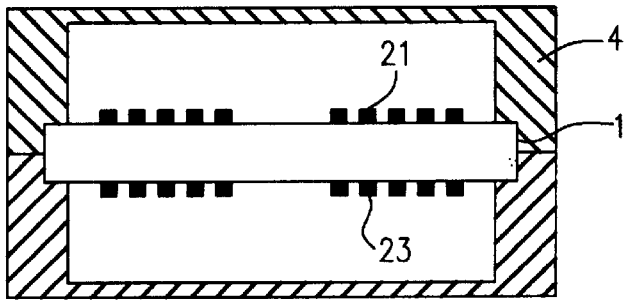
Figure 8C:
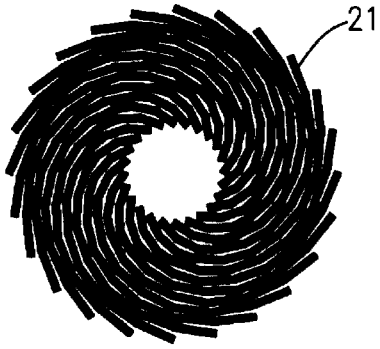
Figure 8D:
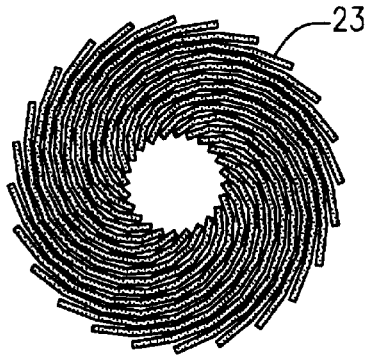

Next, the configuration of the resonator in accordance with a third embodiment of the present invention will be described with reference to FIGS. 8A to 8D, 9 and 9A. FIG. 8A is a top view of the resonator without cavities, FIG. 8B is a central vertical section, and FIGS. 8C and 8D are plan views of two line patterns. In this example, a multiple spiral pattern 21 is formed on the top surface (in the figure) of a dielectric substrate 1, and likewise, another multiple spiral pattern 23 is formed on the bottom surface (in the figure) of a dielectric substrate 1. As shown in FIG. 8C, the multiple spiral pattern 21 is a left-handed multiple spiral pattern, and is similar to the one shown in the first embodiment. FIG. 8D is a view shown when seen from the top surface of the dielectric substrate 1. Here, the line pattern 23 is a right-handed multiple spiral pattern when seen from the top surface side of the dielectric substrate 1. If seen from the bottom surface side of the dielectric substrate 1, therefore, this line pattern 23 will appear to be a left-handed multiple spiral pattern.

Each of the line widths of these line patterns 21 and 23 is set to be substantially equal to the skin depth of the line conductor, at an operating frequency.

Figure 9A:
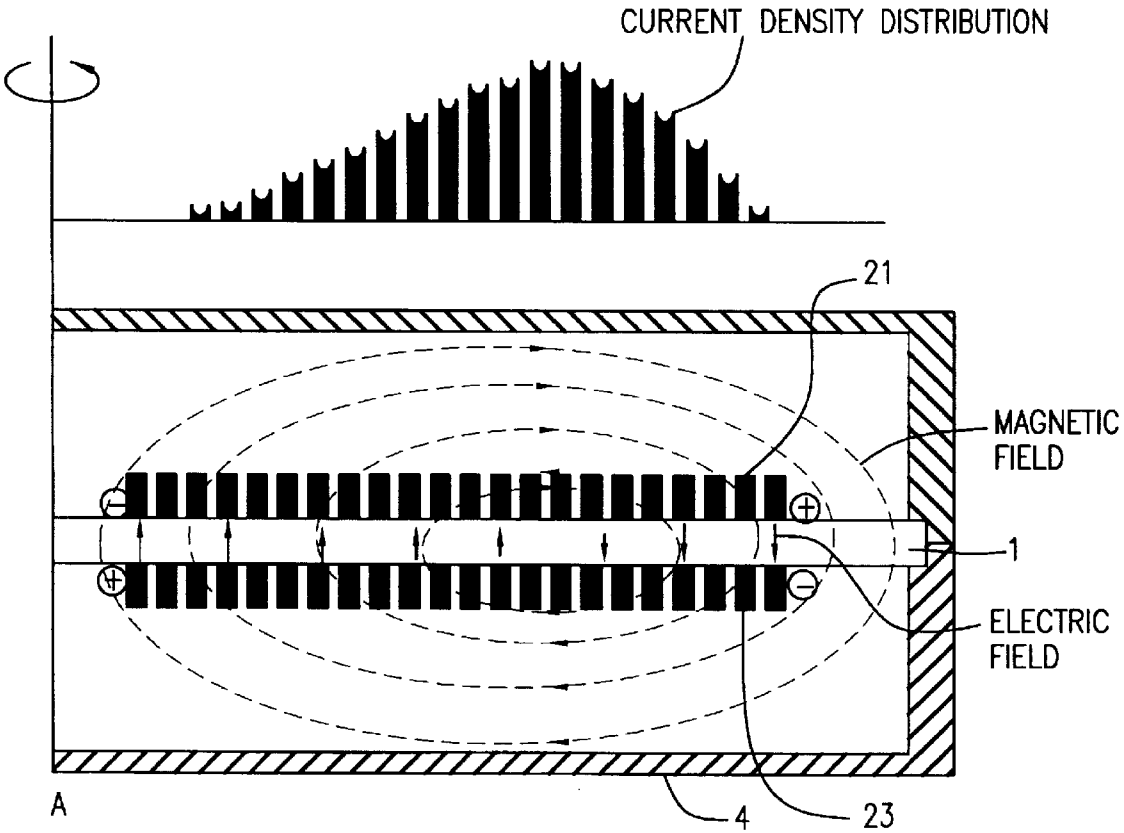
FIGS. 9 and 9A are diagrams showing an example of the distributions of an electromagnetic field and a current density in the resonator shown in FIGS. 8A to 8D.
Figure 9:
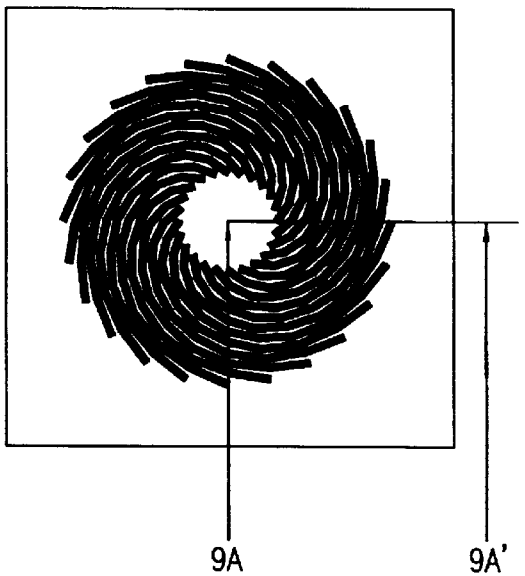

FIG. 9A shows an example of the distribution of an electromagnetic field and that of current density in the resonator shown in FIGS. 8A to 8D. The lower portion of the distribution view shows the distribution of an electromagnetic field and that of current density at the cross-section A–A' of this resonator as shown in FIG. 9. The upper portion of the distribution view shows the distribution of the current density in each of the lines at this cross-section, at the same moment in time.

In the space surrounded by cavities 4, the line pattern 21 constitutes a multiple spiral resonator. Likewise, in the space surrounded by cavities 4, the line pattern 23 constitutes another multiple spiral resonator. In the resonant mode of the resonator formed of the line pattern 21, when the inner periphery portion exhibits the maximum potential, the outer periphery portion exhibits the minimum potential. At the time when a half of resonant period has elapsed, this potential relation between the inner and outer periphery portions is reversed. Therefore, when another multiple spiral line pattern 23 is adjacently disposed to this line pattern 21, there occurs an effect such that an electrostatic capacitance is added, due to the potential difference between the inner periphery portion and the outer periphery portion of the multiple spiral line. More specifically, since an electrostatic capacitance is distributed between the one line pattern 21 and the other line pattern 23 from the inner periphery portion to the outer periphery portion of the line pattern 21, via the dielectric substrate 1, the potential difference generated between the two line patterns becomes opposite in sign, between the inner periphery portion and the outer periphery portion, as shown in FIG. 9A. This is equivalent to the addition of an electrostatic capacitance to the multiple resonator.

Since the resonant frequency is reduced by this added capacitance, the multiple spiral line's diameter for obtaining a predetermined resonant frequency can be reduced, by reducing the length of each line of the multiple spiral line in response to the amount of above-mentioned reduction in the resonant frequency. Also, when forming a multiple spiral line having a given diameter, the number of lines can be increased, and thereby a correspondingly higher loss-reduction effect can be achieved.

Figure 10A:
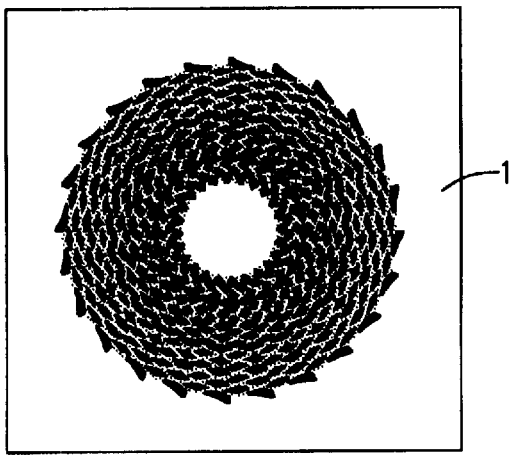
FIGS. 10A to 10D are views illustrating the configuration of a resonator in accordance with a fourth embodiment of the present invention.
Figure 10B:
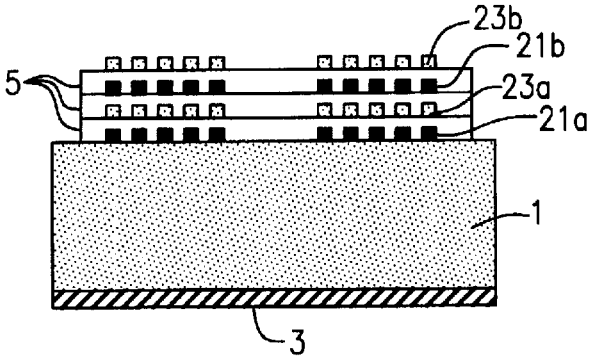
Figure 10C:
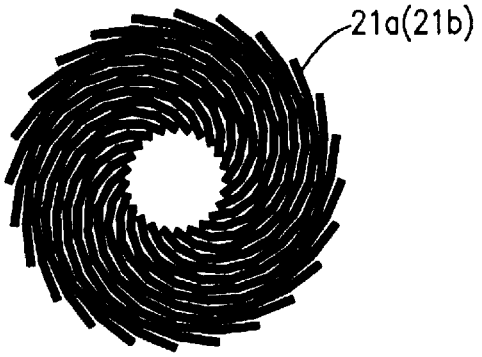
Figure 10D:
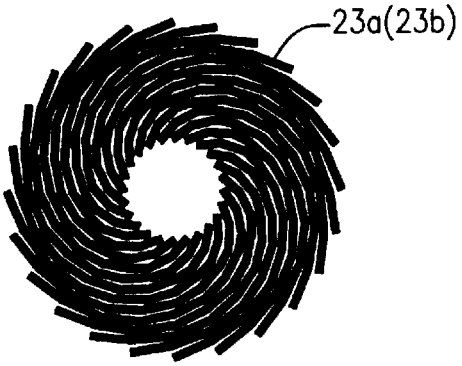

FIGS. 10A to 10D are views illustrating the configuration of a resonator in accordance with a fourth embodiment of the present invention. FIG. 10A is a top view of this resonator, FIG. 10B is a central vertical section thereof. In this example, multiple spiral patterns 21*a*, 23*a*, 21*b*, and 23*b* are successively laminated on the top surface of the dielectric substrate 1 with an insulating layer interposed therebetween. Of these four line patterns, 21*a* and 21*b* are left-handed spiral lines, as shown in FIG. 10C. On the other hand, 23*a* and 23*b* are right-handed spiral lines, as shown in FIG. 10C. If we consider the two layered multiple spiral lines shown in FIGS. 7A to 7D as one set, the above-described structure will equal two sets of these two layered multiple spiral lines. Such a multilayer lamination allows the storage amount of electric field energy to further enhanced, and enables magnetic field energy to be kept at a low loss. This results in a more increased Q value.

Figure 11A:
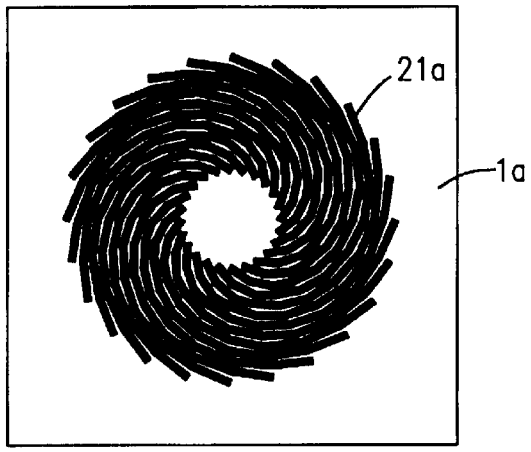
FIGS. 11A to 11D are views illustrating the configuration of a resonator in accordance with a fifth embodiment of the present invention.
Figure 11B:
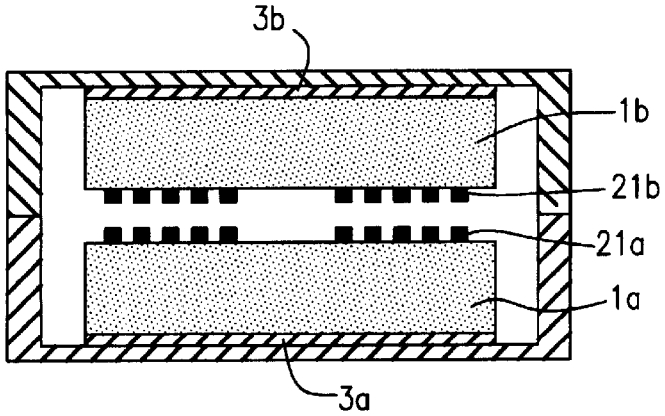
Figure 11C:
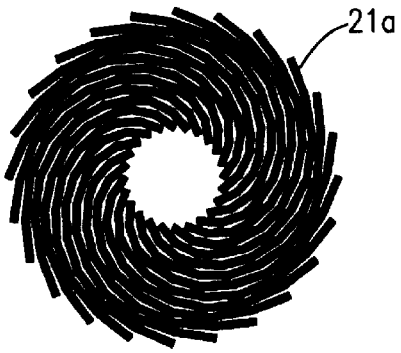
Figure 11D:
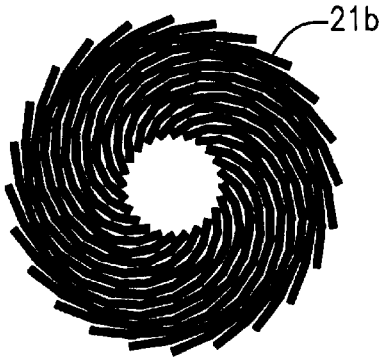

FIGS. 11A to 11D are views illustrating the configuration of a resonator in accordance with a fifth embodiment of the present invention. FIG. 11A is a top view of this resonator without cavities, FIG. 11B is a central vertical section thereof. In this example, a multiple spiral line pattern 21*a* shown in FIG. 11C is formed on the top surface of a dielectric substrate 1*a*, and a ground electrode 3*a* is formed over the entire bottom surface thereof. Also, a multiple spiral line pattern 21*b* shown in FIG. 11D is formed on the bottom surface (in the figure) of a dielectric substrate 1*a*, and a ground electrode 3*a* is formed over the entire top surface thereof.

In this example, the multiple spiral pattern 21 a constitutes a left-handed multiple spiral line, and the multiple spiral pattern 21*b* constitutes a right-handed multiple spiral line. FIG. 11D is, however, a view when seen from the top surface side of the dielectric substrate 1*b*. If seen from the bottom surface side of the dielectric substrate 1*b*, this will appear to be a left-handed multiple spiral pattern like the one shown in FIG. 11C. Therefore, the resonator with the dielectric substrate 1 a and that with the dielectric substrate 1*b* are identical. Since these two resonators are disposed so that the multiple spiral lines thereof are adjacent to each other with an air layer therebetween, an electric field vector is distributed directed to the axial direction of the gap portion between these resonators (the direction perpendicular to the dielectric substrate), as in the case shown in FIG. 9. This results in that an electrostatic capacitance is equivalently added with respect to the case where a single dielectric substrate is used. Thereby, the diameter of the multiple spiral resonator can be reduced, and when forming a multiple spiral line having a given diameter, the loss reduction effect can be enhanced by increasing the number of lines.

Figure 12A:
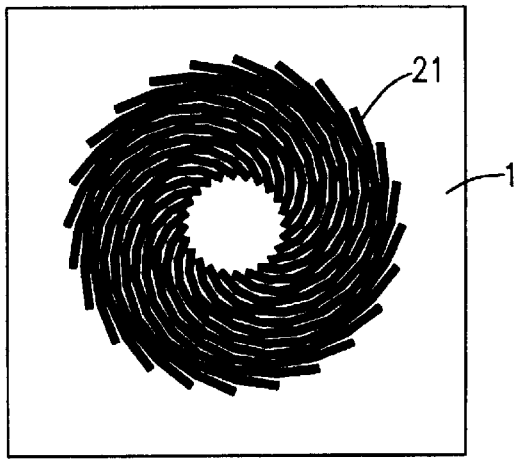
FIGS. 12A to 12D are views illustrating the configuration of a resonator in accordance with a sixth embodiment of the present invention.
Figure 12B:
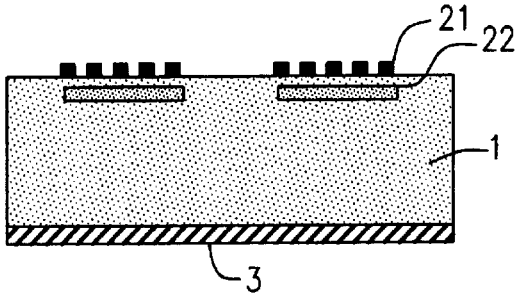
Figure 12C:
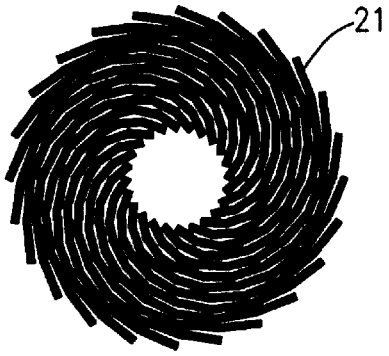
Figure 12D:
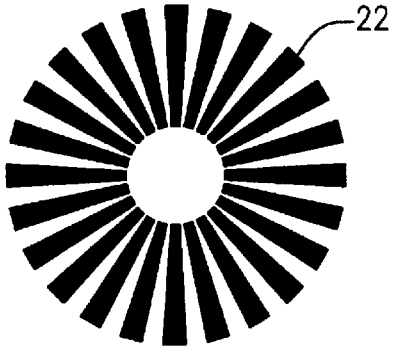
Figure 13A:
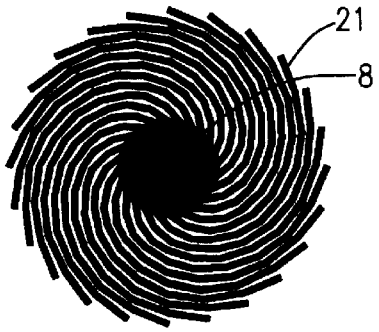
FIGS. 13A to 13H are views illustrating examples of line patterns in resonators in accordance with a seventh embodiment of the present invention.
Figure 13B:
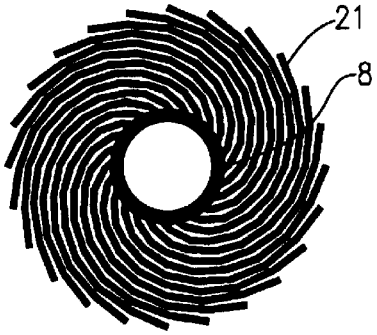
Figure 13C:
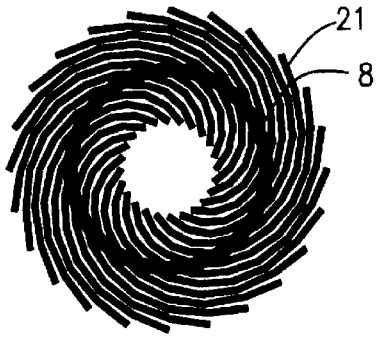
Figure 13D:
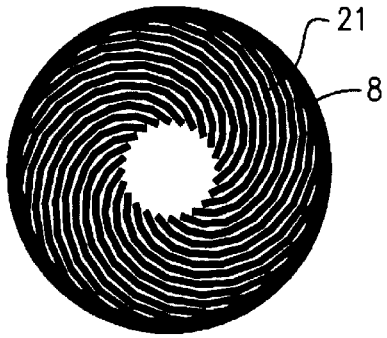
Figure 13E:
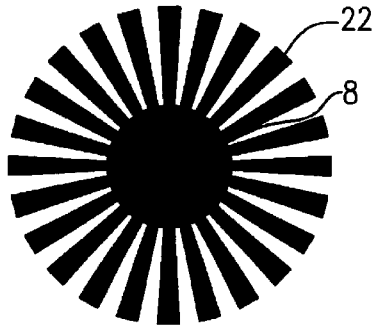
Figure 13F:
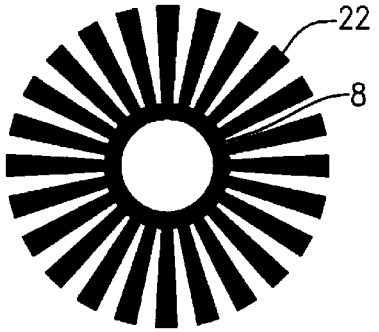
Figure 13G:
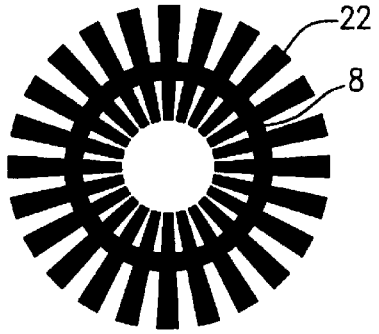
Figure 13H:
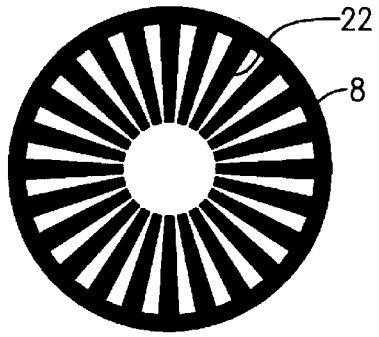

FIGS. 12A to 12D are views illustrating the configuration of a resonator in accordance with a sixth embodiment of the present invention. FIG. 12A is a top view of this resonator, FIG. 12B is a central vertical section thereof. In this example, a radial line pattern 22 shown in FIG. 12D is embedded within the dielectric substrate 1, and a multiple spiral line pattern 21 shown in FIG. 12C is formed on the top surface of a dielectric substrate 1. A ground electrode 3 is formed over the entire bottom surface thereof. The line pattern 22 is embedded within the dielectric substrate by utilizing a known method for producing a ceramic multilayer substrate.

By providing a radial line pattern 22 as a lower layer and a multiple spiral line pattern 21 as an upper layer, a structure wherein an electrostatic capacitance is added is achieved, as in the case of the resonator shown in FIGS. 5A to 5D, thereby providing a small-sized and low-loss resonator.

FIGS. 13A to 13H illustrate other examples of line patterns which are usable in the various types of resonators shown hereinbefore. FIGS. 13A to 13D are each examples of multiple spiral line patterns. In the example FIG. 13A, a circular connection electrode 8 is formed for connecting the inner periphery portion of the line patterns. In the example FIG. 13B, an annular connection electrode 8 is formed at the inner peripheral portion thereof. In the example FIG. 13C, there is formed an annular connection electrode 8 which mutually connects equipotential portions between the inner peripheral portion and the outer peripheral portion of the multiple spiral line pattern. In the example FIG. 13D, an annular connection electrode 8 is formed at the outer peripheral portion thereof.

In this manner, in FIGS. 13A–13D, equipotential portions in the multiple spiral line in the fundamental resonant mode are connected by the connection electrode 8. Thus, with respect to a spurious mode other than the fundamental resonant mode to be used, this connection electrode 8 connects non-equipotential portions, so that the spurious mode is effectively suppressed.

FIGS. 13E to 13H are examples of radial line patterns. In the example FIG. 13E, a circular connection electrode 8 is formed for connecting the inner peripheral edge of the radial pattern. In the example FIG. 13F, an annular connection electrode 8 is formed at the inner peripheral edge thereof. In the example FIG. 13G, there is formed an annular connection electrode 8 which mutually connects equipotential portions between the inner peripheral edges and the outer peripheral edges of the multiple spiral line pattern. In the example FIG. 13H, an annular connection electrode 8 is formed at the outer peripheral edge thereof.

These radial patterns are not used as resonators. However, each of these radial patterns operates in an electromagnetic field of the multiple spiral resonator. Thus, the radial pattern works so as to add an electrostatic capacitance with respect to the half-wave multiple spiral resonator wherein both ends of the inner and outer edges of the radial line pattern are open, and by mutually connecting equipotential portions thereof by the connection electrode 8, the radial pattern can also suppress a spurious mode other than the fundamental resonant mode. Thereby, a spurious-mode suppressing effect is provided, as in the case where 15 the connection electrode is provided to the multiple spiral line.

Next, a construction example of a filter in accordance with the present invention will b15e described with reference to FIG. 14.

Figure 14:
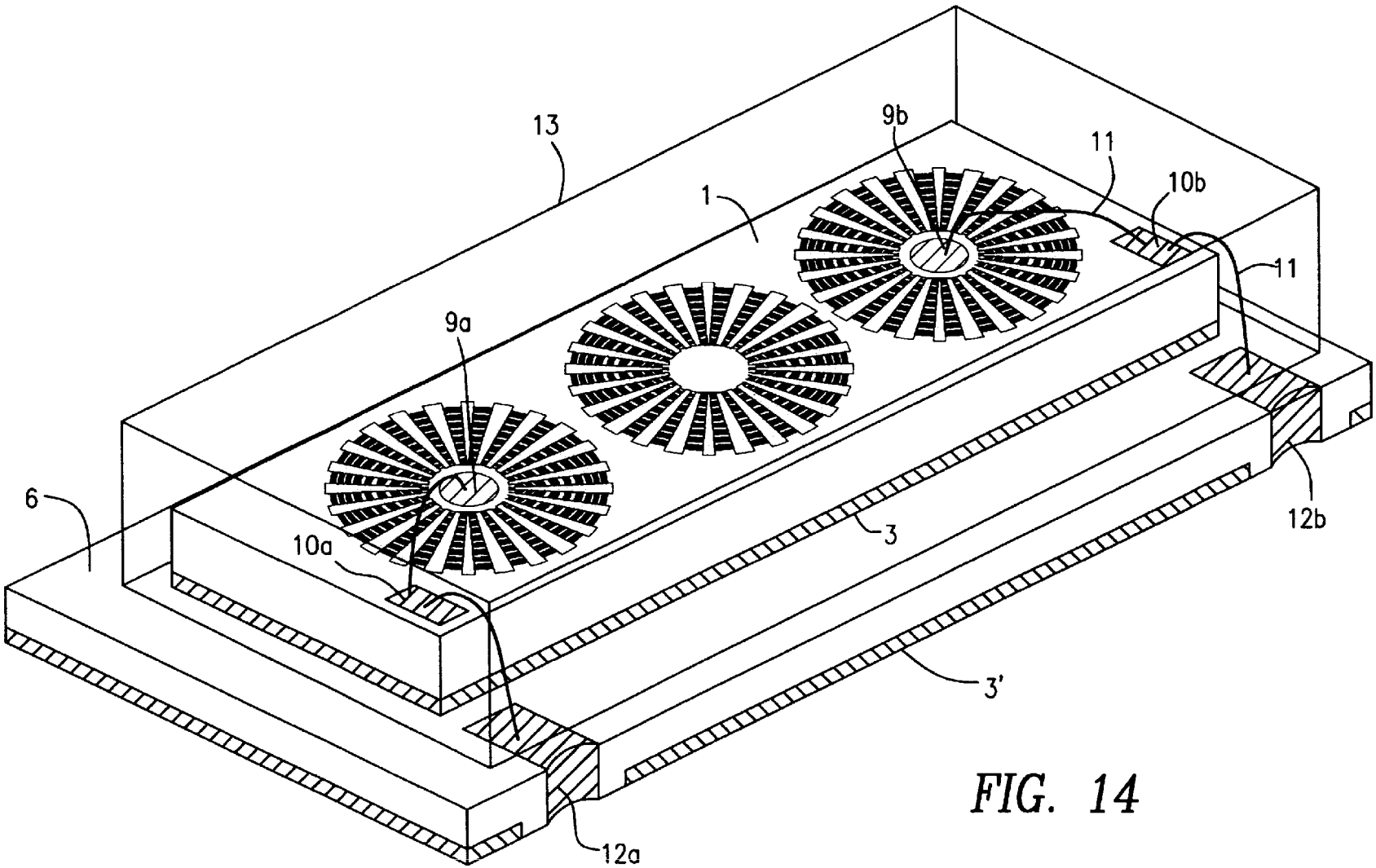
FIG. 14 is a perspective view illustrating the configuration of a filter in accordance with an eighth embodiment of the present invention.

FIG. 14 is a perspective view showing a filter in its entirety. In FIG. 14, reference numeral 1 denotes a dielectric substrate such as an alumina ceramic substrate, or a glass epoxy substrate. By arranging three sets of multiple spiral lines and radial lines on the top surface of the dielectric substrate, three resonators are formed. At the center of each of the dispositional areas of the two outermost multiple spiral lines among the three resonators, there are formed coupling pads 9*a* and 9*b* each of which generates an electrostatic capacitance between the inner peripheral edges of the spiral line and the coupling pad. Bonding pads 10*a* and 10*b* are formed on the top surface of the dielectric substrate 1. A ground electrode 3' is formed over substantially the entire bottom surface of this dielectric substrate 1. Reference numeral 6 denotes an insulating board or a dielectric board. There are formed input/output terminals 12*a* and 12*b* extending from the top surface of the board to the bottom surface via the end face thereof. A ground electrode 3 is formed over substantially the entire bottom surface of the board 6, avoiding the forming area of the input/output terminals 12*a* and 12*b*.

The above-described dielectric substrate 1 is fixedly adhered on the top surface of the board 6. The coupling pads 9*a* and 9*b* and the bonding pads 10*a* and 10*b* are wire-bonded by bonding wires 11, respectively. The top surfaces of the input/output terminals 12*a* and 12*b* of the board 6 and the bonding pads 10*a* and 10*b* on the dielectric substrate 1 are also wire-bonded by bonding wires 11, respectively. A metallic cap 13 is bonded to the top surface of the board 6 by an insulating bonding material so as to cover the dielectric substrate 1 and the bonding wire portions. The figure is drawn by seeing through the cap 13. Thereby, the entire filter is shielded from electromagnetic fields.

With the above-described features, the coupling pad 9*a* is capacitively coupled to the multiple spiral line therearound, this multiple spiral line is inductively coupled to the adjacent multiple spiral line, and is further inductively coupled to another adjacent multiple spiral line. This third-stage multiple spiral line is capacitively coupled to the coupling pad 9*b* which is situated at the center portion thereof. Since the input/output terminals 12*a* and 12*b* are conductively connected to the coupling pads 9*a* and 9*b*, the portion between the input/output terminals 12*a* and 12*b* works as a filter which exhibits band-pass characteristics and has three resonator stages.

Alternatively, the coupling pads 9*a* and 9*b* and the input/output terminals 12*a* and 12*b* may be directly wire-bonded, respectively, without passing through the respective bonding pads 10*a* and 10*b* on the dielectric substrate 1.

In the example shown in FIG. 14, the input/output terminals and the first-stage and last-stage resonators are coupled using the coupling pads 9*a* and 9*b*. Alternatively, however, an electrode for capacitive coupling may be formed at the outer periphery portion of the multiple spiral line constituting either one of the first-stage and last-stage resonators.

Figure 15:
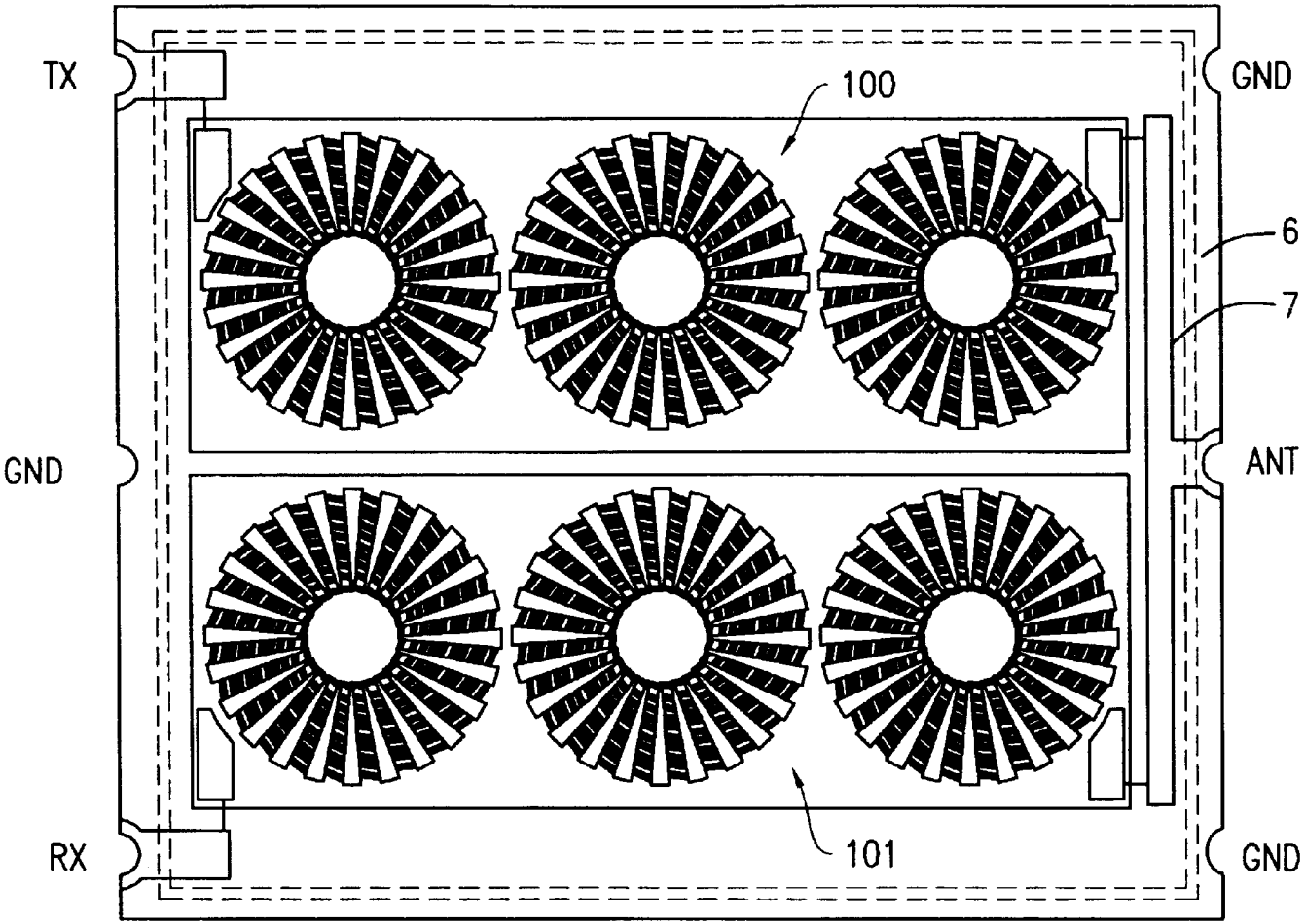
FIG. 15 is a view illustrating the configuration of a duplexer in accordance with a ninth embodiment of the present invention.

FIG. 15 is a view showing the configuration of a duplexer in accordance with the present invention, wherein a shield cover at the upper portion is removed. In the figure, reference numerals 100 and 101 denote filters each including the construction of a dielectric substrate portion shown in FIG. 14. In this example, 100 is used as a transmitting filter, and 101 is used as a receiving filter. These two filters are mounted on the top surface of the board 6. The board 6 has a line 7 for branching, an antenna terminal ANT, a transmitting terminal TX, and a receiving terminal RX formed thereon. The outer coupling electrodes of the filters 100 and 101, and the electrode portions on the board 6 are wire-bonded. A ground electrode is formed over substantially the entire bottom surface 6 except for the terminal portions. At the upper portion of the board 6, a shield cover is installed on the portion indicated by broken lines in the figure.

Figure 16:
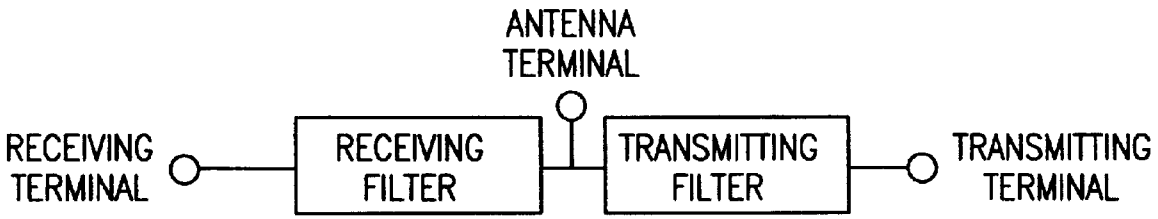
FIG. 16 is a block diagram illustrating the duplexer shown in FIG. 15.

FIG. 16 is a block diagram showing this duplexer. This structure prevents the leakage of transmitted signals into a receiving circuit and that of received signals into a transmitting circuit, and also passes transmitted signals from the transmitting circuit only in a transmitting frequency band to conduct them to the antenna, and passes received signals from the antenna only in a receiving frequency band to provide them to a receiver.

Figure 17:
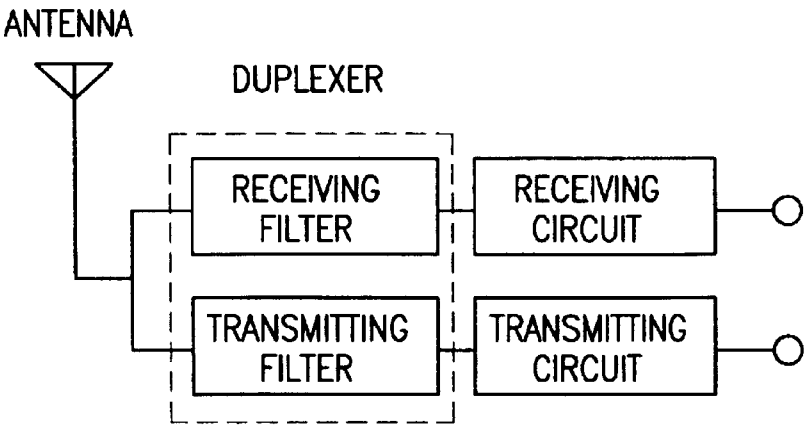
FIG. 17 is a block diagram illustrating the configuration of a communication device in accordance with a tenth embodiment of the present invention.

FIG. 17 is a block diagram showing the configuration of a communication device. Herein, as a duplexer, one having features shown in FIGS. 15 and 16 is used. This duplexer is mounted on a circuit board in such a manner that a transmitting circuit and a receiving circuit are formed on the circuit board, the transmitting circuit is connected to the TX terminal, the receiving circuit is connected to the RX terminal, and an antenna is connect to the ANT terminal.

In the above-described embodiments, the number of the lines of a multiple spiral line and that of the lines of another multiple spiral line or a radial line pattern which is to be disposed adjacently to the above-mentioned multiple spiral line, are equalized. However, the number of lines in the above-mentioned structures may differ from each other. Also, letting the polar coordinates (r, θ) of each spiral line be simply expressed by a polar coordinate equation $r=a\theta$ (Archimedean spiral), when left-handed and right-handed multiple spiral lines have been adjacently disposed in the above-described embodiments, "a" has been set to be constant, and the polarity thereof has been reversed. However, a pair of multiple spiral lines in which the absolute values thereof differ from each other, may be combined. In other words, the combination of these multiple spiral lines may be such that one of the multiple spiral lines has a steep spiral curve and the other one may have a slow spiral curve.

It is not necessary for a multiple spiral line or radial line pattern which is to be disposed adjacently to another multiple spiral line, in a mutually insulated state, to have its inner periphery or outer periphery disposed so as to coincide with the inner or outer periphery of the other multiple spiral line. For example, the diameter of each of the inner and outer peripheries of the above-described other multiple spiral line or radial line pattern may be different from that of the above-described one multiple spiral line.

As explained above, in accordance with the present invention, the current concentration at the edge portions of lines is very efficiently relieved, and thereby the overall power loss is suppressed. Also, since the line length of each of the lines can be shortened, an overall size-reduction of a resonator can be realized. Furthermore, since more lines can be provided in a given occupation area, a correspondingly higher insertion-loss reduction effect can be achieved.

By arranging at least two sets of plural line patterns so that each of the sets is an aggregate of a plurality of lines, and by making the spiral directions thereof to be opposite to each other, the magnetic field energy due to resonance is efficiently retained, and thereby the Q value of the resonator can be increased.

By conductively connecting substantially equipotential portions of at least one set of plural sets of line patterns with respect to each other, the spurious resonant mode can be effectively suppressed.

By constituting lines of pattern lines using a superconductor, the Q value of the resonator can be increased. The current concentration in this case is low, and hence, even if a power density per unit area or unit volume is increased, it is possible to make good use of the low loss characteristics of the superconductor at a level not more than the critical current density, and to make the resonator operate at a high Q value.

By setting each of the line widths of line patterns to be substantially equal to the skin depth of the line conductor or narrower than the skin depth thereof, at an operating frequency, power loss can be remarkably reduced.

Furthermore, in accordance with the present invention, by using a low-loss and high-Q resonator, a low insertion loss and small-sized filter or duplexer can be achieved.

Moreover, in accordance with the present invention, there is provided a communication device which has a low insertion loss at the high-frequency transmission/reception portion and superior communication qualities such as the noise characteristics and the transmission speed, and which has a small overall size.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A resonator, comprising:

a plurality of line patterns on one of a substrate and a film, each of which is an aggregate of a plurality of lines, in each of which first ends and second ends of at least a portion of said plurality of lines are each disposed substantially at inner and outer periphery portions of said aggregate around a predetermined point of said one of said substrate and said film, respectively, and which are disposed on said one of said substrate and said film so as not to intersect each other, and mutually insulated from each other;

each line of at least one of said plurality of line patterns having a spiral shape, being parallel to each other, and being formed on the same surface of said one of said substrate and said film; and each line of at least one of the other line patterns having a pattern different from said spiral shape.

2. The resonator in accordance with claim 1, wherein at least one of said plurality of line patterns has a radial shape.

3. The resonator which resonates in a resonant mode of an integral multiple of a half-wavelength, said resonator comprising:

a line pattern on one of a substrate and a film, which is an aggregate of a plurality of parallel lines each having a spiral shape and formed on the same surface of said one of said substrate and said film, in which first ends and second ends of at least a portion of said plurality of lines are each disposed substantially at inner and outer periphery portions of said aggregate around a predetermined point of said one of said substrate and said film, respectively, in which each of the inner and outer periphery portions of said lines are open-circuited, and said lines are disposed on said one of said substrate and said film so as not to intersect each other; and another line pattern which adds an electrostatic capacitance, utilizing a potential difference or a portion of said potential difference between a voltage node and a voltage antinode in a resonant mode, said other line pattern being disposed on a substrate so as to be insulated from said line pattern.

4. The resonator in accordance with claim 3, wherein at least one of said plurality of line patterns has a radial shape.

5. The resonator in accordance with claim 1 or 3, wherein:

each of at least two of said plurality of line patterns is an aggregate of a plurality of spiral lines, and the spiral directions thereof is opposite to each other.

6. The resonator in accordance with claim 1 or claim 3, wherein, in at least one of said plurality of line patterns, portions which exhibit substantial equipotentialities in a resonant state are conductively connected.

7. The resonator in accordance with any claim 1 or claim 3, wherein at least one of said plurality of line patterns is formed of a superconducting line.

8. The resonator in accordance with claim 1 or claim 3, wherein the width of each of said plurality of line patterns is set to be substantially equal to the skin depth of the line conductor or narrower than the skin depth thereof, at an operating frequency.

9. A filter including signal input/output portions coupled with the resonator in accordance with claim 1 or claim 3.

10. A communication device including a high-frequency circuit, and connected thereto the filter in accordance with claim 9.

11. A duplexer including a transmitting filter and a receiving filter, at least one of said transmitting and receiving filters being the filter in accordance with claim 9.

12. A communication device including a high-frequency circuit, and connected thereto the duplexer in accordance with claim 11.

13. The resonator in accordance with claim 1, wherein said plurality of line patterns are formed on said substrate, and a film covers said plurality of line patterns.

14. The resonator in accordance with claim 1, wherein said plurality of line patterns are formed on said substrate, a film covers said plurality of line patterns, and a second plurality of line patterns are formed on said film.

* * * * *